United States Patent [19]

Wolfsgruber et al.

[11] Patent Number: 4,540,436

[45] Date of Patent: Sep. 10, 1985

[54] TREATMENT AGENT FOR CAST IRON MELTS AND A PROCESS FOR THE PRODUCTION THEREOF

[75] Inventors: Friedrich Wolfsgruber, Tacherting; Ernst A. Weiser, Unterneukirchen; Werner Gmöhling, Hufschlag; Hans Kern, Trostberg; Karl J. Reifferscheid, Karben, all of Fed. Rep. of Germany

[73] Assignees: SKW Trostberg AG, Trostberg; Metallgesellschaft AG, Frankfurt, both of Fed. Rep. of Germany

[21] Appl. No.: 626,634

[22] Filed: Jul. 2, 1984

[30] Foreign Application Priority Data

Jul. 6, 1983 [DE] Fed. Rep. of Germany ..... 3324357
Feb. 9, 1984 [DE] Fed. Rep. of Germany ..... 3404607

[51] Int. Cl.[3] ..... C22C 1/02; C21C 1/10

[52] U.S. Cl. ..... 75/130 A; 75/53; 75/130 R

[58] Field of Search ..... 75/53, 130 A, 130 R

[56] References Cited

U.S. PATENT DOCUMENTS

| | | | |
|---|---|---|---|
| 4,313,758 | 2/1982 | Henning | 75/53 |
| 4,377,411 | 3/1983 | Moore | 75/53 |
| 4,385,030 | 5/1983 | Dremann | 75/53 |

OTHER PUBLICATIONS

AFS–Transactions, 83–108, pp. 263–268, by Dremann.

*Primary Examiner*—Peter D. Rosenberg
*Attorney, Agent, or Firm*—Felfe & Lynch

[57] ABSTRACT

The present invention provides a treatment agent for cast iron melts based upon ferrosilicon magnesium with a silicon content of from 40 to 80% by weight and a magnesium content of from 0.5 to 15% by weight, said agent being in the form of granules with a specific surface area of from 0.2 to 0.8 $m^2/g$. according to BET.

The present invention also provides a process for the production of this treatment agent, wherein a jet of molten ferrosilicon magnesium alloy is directed on to a bounce plate made of fire-resistant material and the melt droplets which bounce back from bounce plate are allowed to solidify in a liquid-filled collection receiver.

15 Claims, No Drawings

TREATMENT AGENT FOR CAST IRON MELTS AND A PROCESS FOR THE PRODUCTION THEREOF

The present invention is concerned with a treatment agent for the production of cast iron with spheroidal or vermicular graphite, as well as with a process for the production of this agent.

It is known to use magnesium-containing treatment agents for the production of cast iron with spheroidal or vermicular graphite. The addition of the magnesium improves the strength properties of the cast iron by its property of converting the graphite into the spheroidal or compact graphite form. Admittedly, it is, in principle, possible to introduce metallic magnesium into the molten iron but, because of the danger of explosion; special measures are necessary, most of which are technically very laborious.

Therefore, attempts have also been made to use magnesium-containing alloys, for example ferrosilicon magnesium, instead of metallic magnesium. Nevertheless, violent or non-uniform reactions can occur, which involve the danger of ejection of molten cast iron from the treatment ladle.

According to Federal Republic of Germany Patent Specification No. 18 00 447, an attempt was made to solve this problem by using a mixture of fine-grained calcium silicon or ferrosilicon magnesium which had been coated with salts of the alkaline earth metals or of the rate earths. Quite apart from the fact that the production of such coatings gives rise to additional energy costs because of the necessary drying step, it is not always desirable to introduce further components into the melt.

Federal Republic of Germany Patent Specification No. 17 58 768 describes treatment agents which have a coating of fire-resistant material, the use of which reduces the violence of the reaction and the treatment can be controlled.

Finally, Federal Republic of Germany Patent Specification No. 21 57 395 suggests coating magnesium-containing ferrosilicon alloys with powdered, binding agent-containing treatment materials of graphite, sulphur or metals, the binding agents used being condensation resins, starch or cellulose derivatives or inorganic materials, such as waterglass.

The disadvantages of all of these known agents are to be seen in the fact that these must be provided with some sort of coating in additional processes and that, in this manner, undesired accompanying materials are sometimes introduced into the melt.

Therefore, it is an object of the present invention to provide a treatment agent for cast iron melts based on ferrosilicon magnesium, which agent does not suffer from the above-mentioned disadvantages and which, without the help of any kind of coatings, makes possible a uniform and ejection-free reaction.

Thus, according to the present invention, there is provided a treatment agent for cast iron melts based upon ferrosilicon magnesium with a silicon content of from 40 to 80% by weight and a magnesium content of from 0.5 to 15% by weight, said agent being in the form of granules with a specific surface area of from 0.2 to 0.8 $m^2/g$. according to BET.

Surprisingly, we have found that the agent according to the present invention, with its definite specific surface area, enters into an extremely uniform and quiet reaction with the iron melt. Furthermore, pieces of cast iron produced with the treatment agent according to the present invention display only small slag or surface faults, which was also not to have been foreseen.

The treatment agents according to the present invention are ferrosilicon magnesium granules and, besides having a specific surface area of 0.2 to 0.8 $m^2/g$. according to the BET method, preferably have a particle size of from 0.1 to 20 mm. and more preferably of from 1 to 3 mm. Their specific surface area is thus substantially greater than that of normal, broken ferrosilicon magnesium particles of normal granulation. This large specific surface area is to be attributed to the porous and fissured surface structure of the granules which is brought about by the production process.

In a preferred embodiment, the agent according to the present invention also contains from 2 to 50% by weight of alkaline earth metal fluorides, for example calcium fluoride or magnesium fluoride, and/or of fluorides of the rare earths, referred to the weight of the treatment agent. These additives have a positive influence on the slag formation.

In addition, the ferrosilicon magnesium granules of the present invention can also contain from 0.1 to 5% by weight of rare earths, referred to the weight of the treatment agent, the rare earths thereby preferably consisting of 40 to 100% by weight and especially from 40 to 50% by weight of cerium or of 100% by weight of lanthanum. These additives further improve the spheroidal graphite formation of the cast iron.

This structure of the granules is, according to the present invention, obtained by directing a jet of molten ferrosilicon magnesium alloy on to a bounce plate of fire-resistant material, the melt droplets bouncing back from the bounce plate being allowed to solidify in a liquid-filled collecting receiver. The basic principle of this method of granulation is known for the production of granulates with a smooth surface and can be carried out, for example, with a device as described in Federal Republic of Germany Patent Specification No. 10 24 315. However, in the case of the ferrosilicon magnesium melts, there is, surprisingly, not obtained the usual granulates with a smooth surface but rather fissured grains with a porous surface structure and with a large specific surface area. The dropping height of the molten jet is preferably about 0.1 to 1.0 m. There is thus obtained the desired grain size range of from 0.1 to 20 mm. and preferably of from 1 to 3 mm. Since the grain size is also dependent upon the rate of flow of the melt, it is recommended to use the molten ferrosilicon magnesium alloy in an amount of from 50 to 500 kg./minute. It is also possible to operate with other amounts and dropping heights but the above-mentioned parameters have proved to be especially advantageous.

The nature of the liquid in the collection container has no or only a slight influence on the surface properties and on the specific surface area. The only thing which is necessary is that the liquid is chemically inert towards the molten ferrosilicon magnesium alloy. For economic reasons, an aqueous liquid is preferred.

The ferrosilicon magnesium treatment agent according to the present invention, which has a silicon content of from 40 to 80% by weight and a magnesium content of from 0.5 to 15% by weight, is, for the production of cast iron with spheroidal or vermicular graphite, used in an amount of from 0.1 to 4% by weight, referred to the weight of the iron melt. The treatment can take place according to the conventional processes, for example the covering over method (sandwich method) or the in-mould method. In the case of the covering over method, because of the extremely quiet and uniform reaction, it is even possible to omit covering the ferrosilicon magnesium granules with steel chips or iron turnings, without the yield of magnesium decreasing considerably due to combustion losses.

However, due to the uniform and ejection-free reaction, not only are high magnesium yields achieved but, at the same time, material losses due to ejection are prevented.

The treatment agent according to the present invention brings about a greater tendency to ferritisation than comparable magnesium-containing agents, the ductility values of the cast pieces thereby being decisively improved. Furthermore, the cast pieces have less slag and surface faults so that this quality of the cast pieces is also improved.

The following Examples are given for the purpose of illustrating the present invention:

EXAMPLE 1

A ferrosilicon magnesium alloy of the following composition:

| | |
|---|---|
| silicon | 46.1% by weight |
| magnesium | 5.5% by weight |
| rare earths | 0.78% by weight |
| calcium | 0.7% by weight |
| aluminium | 1.35% by weight |
| remainder iron | |

is melted in an induction furnace and, with the help of a transport ladle, poured into a graphite crucible which functions as a tundish and has an outlet cross-section of 20 mm.

The molten alloy leaves the tundish with a temperature of 1450° C. at a rate of 80 kg. per minute and, in the form of a pouring jet, impinges upon a bounce plate made of fire-resistant material which is positioned 0.64 m. below the outlet opening. The liquid material bounces back from this bounce plate in the form of small droplets and these are collected in a water-filled container which is positioned 4.5 m. below the bounce plate. The particles obtained in granular form have the following grain size distribution:

| | |
|---|---|
| >8 mm. | 0.1% |
| 6.3 mm. | 1.0% |
| 5.6 mm. | 2.4% |
| 4.0 mm. | 9.0% |
| 2.8 mm. | 18.0% |
| 2.0 mm. | 26.2% |
| 1.0 mm. | 34.0% |
| 0.5 mm. | 7.8% |
| <0.5 mm. | 1.4% |

The specific surface area thereof is, on average, 0.35 $m^2/g$.

EXAMPLE 2

1500 kg. basic iron are melted in a hot air blast cupola furnace and desulphurised with 2.5% by weight of calcium carbide. Subsequently, the iron melt is transferred to a grid frequency induction furnace and, after a superheating to 1530° C., it has the following composition:

| | |
|---|---|
| carbon | 3.77% by weight |
| silicon | 1.67% by weight |
| manganese | 0.13% by weight |
| phosphorus | 0.038% by weight |
| sulphur | 0.013% by weight |
| remainder iron. | |

This iron melt is treated by the covering over process, using ferrosilicon magnesium granules with a grain size of from 0.5 to 6 mm. and with a specific surface area of 0.3 $m^2/g$., the granules having the following composition:

| | |
|---|---|
| silicon | 47.6% by weight |
| magnesium | 5.8% by weight |
| rare earths | 0.7% by weight |
| calcium | 0.6% by weight |
| aluminium | 0.8% by weight |
| remainder iron. | |

For this purpose, 26.25 kg. of the treatment agent are placed in the bottom trough of the treatment ladle, a covering over of the granules with steel chips being omitted. The molten iron with a temperature of 1520° C. is poured into the ladle in such a manner that the iron jet does not impinge directly on the granules present in the bottom trough. The reaction, which, after 33 seconds, is ended shortly before the filling of the ladle, proceeds quietly and uniformly and also, in comparison with analogous magnesium treatments, without the appearance of a strong evolution of fumes.

After removal of the slag, an analysis is carried out, which gives the following values:

| | |
|---|---|
| carbon | 3.55% by weight |
| silicon | 2.50% by weight |
| manganese | 0.12% by weight |
| sulphur | 0.010% by weight |
| magnesium | 0.058% by weight. |
| remainder iron. | |

In spite of the omission of a covering over, the magnesium yields amount to 57%.

The subsequent seeding with 0.25% by weight of FeSi 75 takes place as a ladle seeding upon pouring over into a casting ladle.

The metallographic investigation of the cast iron parts with a wall thickness of from 8 to 35 mm. gives, in all cross-sections, a formation of at least 90% spheroidal graphite in the case of 80 to 90% by weight of ferrite and 10 to 20% by weight of perlite as structural components. Cementite is not observed in any of the samples investigated. Furthermore, the cast pieces are free of reaction products and slag influences.

For the testing of the ferritisation tendency of the melts, wall thickness samples with wall thicknesses of 2.5, 5, 7.5 and 10 mm. are cast and investigated metallographically. Corresponding to the wall thickness, the proportion of ferrite decreases from 70% by weight at a wall thickness of 10 mm. to 40% by weight at a wall thickness of 2.5 mm. All the samples are free of cementite.

On a Y-30 mm. sample, the following strength values are determined according to German Industrial Standard DIN 1693:

| | |
|---|---|
| elastic limit Rp 0.2% | 295 N/mm$^2$ |
| tensile strength | 430 N/mm$^2$ |
| breaking elongation $A_5$ | 20% |
| breaking contraction | 24% |
| Brinell hardness 30/2.5 | 151 units. |

EXAMPLE 3

For the production of cast iron with spheroidal graphite according to the in-mould process, the basic iron is melted in a casting furnace with bottom-pour removal, the temperature of the melt being 1445° C. and the iron having the following composition:

| | |
|---|---|
| carbon | 3.80% by weight |
| silicon | 2.15% by weight |
| manganese | 0.21% by weight |
| phosphorus | 0.031% by weight |
| sulphur | 0.005% by weight |
| remainder iron. | |

For the casting of a cast piece with a cast weight of 29.8 kg., an intermediate chamber made for the reception of ferrosilicon magnesium granules is filled to a volume of about 300 cm$^3$ with 209 g. of granules with a grain size of from 1 to 3.0 mm. so that the chamber is about half filled. The ferrosilicon magnesium treatment agent has a specific surface area of 0.45 m$^2$/g. and has the following composition:

| | |
|---|---|
| silicon | 47.1% by weight |
| magnesium | 4.5% by weight |
| calcium | 1.84% by weight |
| aluminum | 1.2% by weight |
| rare earths | 1.0% by weight |
| remainder iron. | |

The pour-out of the casting mould takes place in 9 seconds, the reaction during the casting procedure taking place very quietly and uniformly. Furthermore, no reactions subsequent to the casting are observed. An opening and inspection of the intermediate chamber shows that all the ferrosilicon magnesium granules have been taken up by the melt flowing through the intermediate chamber.

The end analysis of the cast sample gives the following composition:

| | |
|---|---|
| carbon | 3.75% by weight |
| silicon | 2.49% by weight |
| manganese | 0.21% by weight |
| phosphorus | 0.032% by weight |
| sulphur | 0.005% by weight |
| magnesium | 0.028% by weight |
| remainder iron. | |

The metallographic investigations carried out on samples from the cast piece with a standard wall thickness of 8 mm. show a formation of spheroidal graphite of more than 95% in the case of a ferrite content of 95 to 100% and a residual content of perlite of 0 to 5% as structural components. By means of a forceful destruction of the cast piece with the help of a press, breakage samples are obtained, the break surfaces of which are free from inclusions.

EXAMPLE 4

For the production of cast iron with vermicular graphite according to the sandwich process, 30 kg. of basic iron from a pure steel batch are melted in an average frequency furnace which, after carbonisation with graphite, has the following analysis:

| | |
|---|---|
| carbon | 3.46% by weight |
| manganese | 0.35% by weight |
| phosphorus | 0.025% by weight |
| silicon | 2.10% by weight |
| sulphur | 0.014% by weight |
| remainder iron. | |

For the treatment of this iron melt, 0.8% by weight (240 g.) of ferrosilicon magnesium granules are shaken into the bottom trough of a graphite crucible and the basic iron, which has a temperature of 1500° C., is poured thereover. The treatment agent used has a specific surface area of 0.3 m$^2$/g. and has the following analysis:

| | |
|---|---|
| silicon | 46.0% by weight |
| magnesium | 5.4% by weight |
| calcium | 0.85% by weight |
| aluminium | 0.8% by weight |
| rare earths | 2.7% by weight |
| remainder iron. | |

Before casting the melt to give a U-sample according to German Industrial Standard DIN 1693, the melt is seeded with 0.3% by weight of ferrosilicon by stirring in and cast at a temperature of 1405° C. three minutes after the treatment with ferrosilicon magnesium, the following analysis values being obtained:

| | |
|---|---|
| carbon | 3.44% by weight |
| manganese | 0.35% by weight |
| phosphorus | 0.025% by weight |
| silicon | 2.64% by weight |
| sulphur | 0.012% by weight |
| magnesium | 0.019% by weight |
| remainder iron. | |

For the sample rods produced from the U-sample, there are determined the following strength values:

| | |
|---|---|
| elastic limit Rp 0.2% | 335 N/mm$^2$ |
| tensile strength | 405 N/mm$^2$ |
| breaking elongation $A_5$ | 5.6% |
| Brinell hardness 30/2.5 | 163/167 |

The metallographic investigation carried out on test base sections showed about 90% vermicular graphite with about 10% spheroidal graphite on a preponderantly ferritic matrix, as well as a residual content of perlite of about 25%.

We claim:

1. A treatment agent for cast iron melts, the treatment agent comprising ferrosilicon magnesium with a silicon content of from 40 to 80% by weight and a magnesium content of from 0.5 to 15% by weight, said agent being in the form of granules with a specific surface area of from 0.2 to 0.8 m$^2$/g. according to BET.

2. Agent according to claim 1, wherein the granules have a size of from 0.1 to 20 mm.

3. Agent according to claim 2, wherein the granules have a size of from 1 to 3 mm.

4. Agent according to claim 1, wherein it contains from 2 to 50% by weight of fluorides of the alkaline earth metals and/or of the rare earths, referred to the weight of the treatment agent.

5. Agent according to claim 1, wherein it contains from 0.1 to 5% by weight of rare earths, referred to the weight of the treatment agent.

6. Agent according to claim 5, wherein the rare earths consist of from 40 to 10% of cerium.

7. Agent according to claim 6, wherein the rare earths consist of from 40 to 50% by weight of cerium.

8. Agent according to claim 5, wherein it contains lanthanum as rare earth.

9. A process for the production of a treatment agent for cast iron melts, the treatment agent comprising ferrosilicon magnesium with a silicon content of from 40 to 80% by weight and a magnesium content of from 0.5 to 15% by weight, said agent being in the form of granules with a specific surface area of from 0.2 to 0.8 $m^2/g$. according to BET comprising the steps of directing a jet of molten ferrosilicon magnesium alloy on to a bounce plate made of fire-resistant material and allowing the melt droplets which bounce back from the bounce plate to solidify in a liquid-filled collection receiver.

10. Process according to claim 9, wherein the dropping height of the molten jet is from 0.1 to 1.0 m.

11. Process according to claim 9, wherein the molten ferrosilicon magnesium alloy is allowed to impinge upon the bounce plate in an amount of from 50 to 500 kg. per minute.

12. Process according to claim 9, wherein a collection receiver is used which contains an aqueous liquid.

13. In a method for the production of cast iron with spheroidal or vermicular graphite, the improvement comprising introducing into the iron melt a treatment agent comprising ferrosilicon magnesium with silicon content of from 40 to 80% by weight and a magnesium content of from 0.5 to 15% by weight, said agent being in the form of granules with a specific surface area of from 0.2 to 0.8 $m^2/g$. according to BET.

14. A method according to claim 13, wherein the treatment agent is used in an amount of from 0.1 to 4% by weight, referred to the weight of the iron melt.

15. A treatment agent for cast iron melts, the treating agent comprising ferrosilicon magnesium with a silicon content of from 40 to 80% by weight and a magnesium content of from 0.5 to 15% by weight, said agent being in the form of granules with a specific surface area of from 0.2 to 0.8 $m^2/g$. according to BET; formed by a process comprising the steps of directing a jet of molten ferrosilicon magnesium alloy on to a bounce plate made of fire-resistant material and allowing the melt droplets which bounce back from the bounce plate to solidify in a liquid-filled collection receiver.

* * * * *